US010749243B2

(12) United States Patent
Gomelsky et al.

(10) Patent No.: US 10,749,243 B2
(45) Date of Patent: Aug. 18, 2020

(54) REPLACEABLE CARD FOR ANTENNA FREQUENCY TUNING

(71) Applicant: MOTOROLA SOLUTIONS, INC, Chicago, IL (US)

(72) Inventors: Alexander Gomelsky, Holon (IL); Michael Astanovsky, Hadera (IL); Nitzan Berkovich, Rehovot (IL); Lionid Kodner, Modi'in (IL)

(73) Assignee: MOTOROLA SOLUTIONS, INC., Chicago, IL (US)

( * ) Notice: Subject to any disclaimer, the term of this patent is extended or adjusted under 35 U.S.C. 154(b) by 95 days.

(21) Appl. No.: 16/172,908

(22) Filed: Oct. 29, 2018

(65) Prior Publication Data

US 2020/0136232 A1 Apr. 30, 2020

(51) Int. Cl.

| | |
|---|---|
| ***H01Q 1/34*** | (2006.01) |
| ***H01Q 1/22*** | (2006.01) |
| ***H01Q 1/12*** | (2006.01) |
| ***H01Q 9/04*** | (2006.01) |
| ***H01Q 1/24*** | (2006.01) |

(52) U.S. Cl.
CPC ..... *H01Q 1/2275* (2013.01); *H01Q 1/1264* (2013.01); *H01Q 1/243* (2013.01); *H01Q 9/0442* (2013.01)

(58) Field of Classification Search
CPC ... H01Q 1/2275; H01Q 1/1264; H01Q 9/0442
See application file for complete search history.

(56) References Cited

U.S. PATENT DOCUMENTS

| | | | | |
|---|---|---|---|---|
| 4,760,401 | A | 7/1988 | Imazeki | |
| 5,828,346 | A | 10/1998 | Park | |
| 6,456,245 | B1 | 9/2002 | Crawford | |
| 6,535,172 | B2 | 3/2003 | Hirabayashi | |
| 6,573,868 | B2 | 6/2003 | Johnson et al. | |
| 2003/0085288 | A1 | 5/2003 | Luu | |
| 2008/0165066 | A1 | 7/2008 | Tiscareno et al. | |
| 2013/0321219 | A1 | 12/2013 | Cho et al. | |
| 2018/0316082 | A1* | 11/2018 | Keller, III | H01Q 1/2275 |

* cited by examiner

*Primary Examiner* — Graham P Smith
(74) *Attorney, Agent, or Firm* — Barbara R. Doutre

(57) ABSTRACT

An improved antenna configuration for a communication device is provided that enables ultra wideband operation. The antenna may be formed of two sections, a primary section built into the communication device and a replaceable secondary section disposed on a data card. The primary section is common for all frequency bands of operation which the antenna is intended to cover. The replaceable secondary section is unique to predetermined frequency bands and provides tuning for the overall antenna. A data card tray antenna configuration is also provided which is suitable for a stand-alone antenna or as part of a sectional antenna.

24 Claims, 4 Drawing Sheets

REPLACEABLE CARD FOR ANTENNA FREQUENCY TUNING

FIELD OF THE INVENTION

The present invention relates to antennas for portable communication devices, and more particularly to antenna configurations that can support a plurality of wireless technology standards.

BACKGROUND

Communication devices which operate over different frequency bands are considered desirable, in private markets and enterprise, and particularly in the public-safety arena where such devices are used by such agencies as police departments, fire departments, emergency medical responders, and military to name a few. The use of separate antennas to cover different frequency bands is often not a practical option in view of the portability and size limitations of portable devices. There is need for multiband antenna structures that can cover multiple bands providing for an overall wideband operation. However, achieving multiband functionality can prove quite challenging in the portable communication device domain. The incorporation of separate antennas and matching networks may result in a prohibitively large structure, unsuitable for portable devices having limited size constraints. Efficiency of operation and coexistence interference issues are also major concerns in multiband antenna designs. The addition of frequency bands after product release can also be problematic, as designs are typically based on a limited, fixed predefined list of frequency bands.

Accordingly, there is a need for an improved antenna configuration providing improved multiband capability for a portable communication device.

BRIEF DESCRIPTION OF THE FIGURES

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
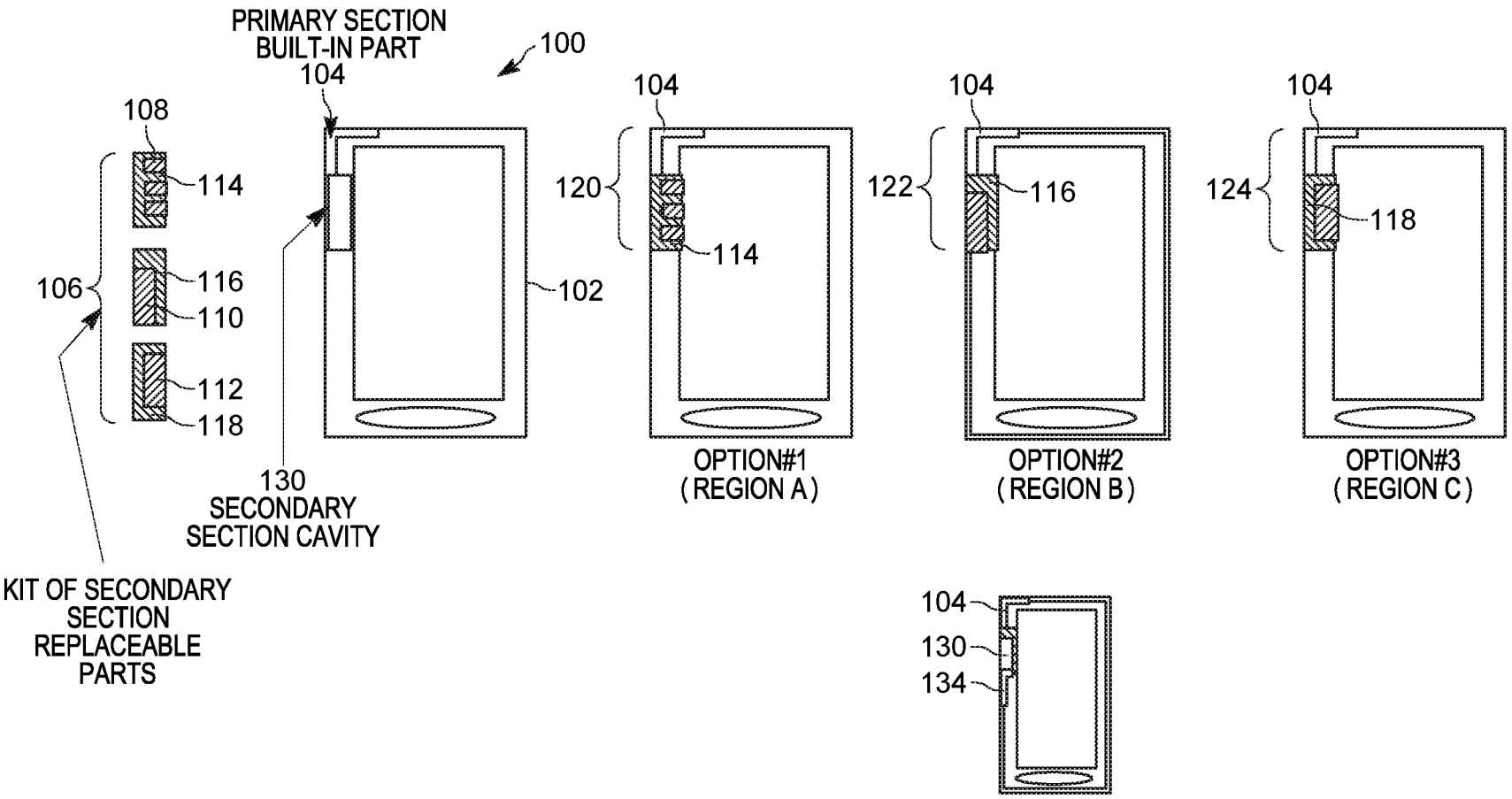
FIG. 1 shows a portable communication device interchangeably accepting a plurality of replaceable cards in accordance with some embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION

Briefly, there is provided herein an improved antenna configuration for a communication device that enables ultra wideband operation. In some embodiments, the antenna may be formed of two sections, a primary section built into the communication device and a replaceable secondary section formed on a card. The primary section is common for all frequency bands of operation which the antenna is intended to cover. The replaceable secondary section is unique to predetermined frequency bands and provides tuning for the overall antenna. The use of two sections allows the communication device to be configurable to a plurality of bands thereby providing for an ultra wideband frequency range. The predetermined frequency bands can be configured according to use cases and/or geographical regions and/or different carriers. The secondary section takes the form of a replaceable card which can be easily inserted and removed from the communication device. A data card tray antenna configuration is also provided which is suitable for a standalone antenna or as part of a sectional antenna. The antenna configurations provided herein is highly beneficial to portable communication devices, such as portable radios, remote speaker microphones and other wearable electronic devices.

FIG. 1 shows a portable communication device 100 formed in accordance with the embodiments. In accordance with the embodiments, communication device 100 comprises a housing 102 and a primary antenna section 104 permanently located in the housing, the housing being configured with a slot, or cavity, 130 for interchangeably accepting a plurality of replaceable cards 106, each replaceable card 108, 110, 112 having a secondary antenna section 114, 116, 118 respectively disposed thereon. In accordance with the embodiments, each secondary antenna section 114, 116, 118 electronically couples to the primary antenna section 104 thereby forming a complete antenna entirely within the housing 102. Each completed antenna configuration provides optimized efficiency at one or more predetermined frequency ranges thereby advantageously providing multiband frequency operation of the portable communication device. Each of the secondary antenna sections preferably provides turning of the primary antenna section to suit a particular customer's use case and/or geographical region, thereby providing customizable multiband operation.

As shown in FIG. 1, the primary antenna section 104 can combine with secondary antenna section 114 to form complete antenna 120. Complete antenna 120 may optimized for efficient operation over a first set of predetermined frequency ranges. The first set predetermined frequency ranges provide a first antenna option (Option 1) which may be optimized for a first geographic region and/or service carrier, indicated as Region A. Each region may provide several carriers and each carrier operates using different frequency bands.

The primary antenna section 104 can combine with the different, secondary antenna section 116 to form another complete antenna 122. Complete antenna 122 may be optimized for efficient operation over a second set of predetermined frequency ranges. The second set of predetermined frequency ranges provide a second antenna option (Option 2) which may optimized for a second geographic region and/or different service carrier, indicated as Region B. Again, each region may have several carriers and each carrier operates using different frequency bands The primary antenna section 104 may also combine with secondary antenna section 116 to form complete antenna 124. Complete antenna 124 may be optimized for efficient operation over a third set of predetermined frequency range. The third set of predetermined frequency ranges provide a third antenna option (Option 3) which may be optimized for a third geographic region and/or another service carrier, indicated as Region C. Again, each region may have several carriers and each carrier operates using different frequency bands.

While shown with three options, it is to be appreciated that additional or fewer options may be utilized. Indeed one of the additional advantages of the interchangeable secondary antenna approach is that the communication device 100 can be updated in accordance with customer/user requests, without having to replace the entire communication device. The replaceable card 106 with second antenna section disposed thereon is advantageously user-replaceable, factory replaceable, and service shop replaceable. Each replaceable card 106, once inserted into cavity 130, may also beneficially provide sealing against the housing 102 to prevent the intrusion of water, dust or debris. Such sealing may be formed, for example, as an over-molded rubber seal portion formed along the outer exposed edge of the card or provided by a rubber gasket mounted along the entire perimeter of the card.

The various predetermined frequency ranges are not required to be adjacent or consecutive frequency ranges. For example, first complete antenna 120 may be optimized to operate with maximum efficiency at 2000 MHz, 2500 MHz and 5000 MZ, while second complete antenna 122 may be optimized to operate with maximum efficiency at 1000 MHz, 3000 MHz and 5800 MHz. Some replaceable cards may cover a single frequency range, while other replaceable cards may cover more than one frequency range. For example, a 4G device may support multiple frequency ranges, and the plurality of secondary antenna sections disposed on the replaceable cards provide turning to the primary antenna section to improve efficiency over those 4G frequency ranges. Also, the frequency ranges may be optimized to accommodate one protocol or different protocols. For example, first complete antenna 120 may be optimized to operate over a 3G protocol, and second complete antenna 122 may be optimized to operate over a 2G protocol. The plurality of replaceable cards with secondary antenna section disposed thereon provide multiband coverage for at least one of: 5G, 4G, 3G, 2G, WiFi, BLUETOOTH, Global Navigation Satellite System (GNSS), ZigBee, Terrestrial Trunked Radio (TETRA), Land Mobile Radio (LMR), Long Term Evolution (LTE) direct protocols, or any other wireless protocols.

The primary antenna section 104 may be configured in a variety of shapes suitable for operation within the housing, for example planar Inverted-F antenna (PIFA), L-shape antenna, loop antenna, to name a few. The primary antenna section 104 is not required to be planar. The secondary antenna sections 106 comprises a planar radiator suitable for being disposed on a card and may further provide passive tuning and matching elements. The two antenna sections are electronically coupled via inductive coupling, capacitive coupling, contact interface, or any suitable conductive interface for mating the primary and secondary antenna sections. The secondary antenna section thus controls the tuning of the primary antenna section. Multiband operation is provided by the various antenna configurations. Insertion of any of the cards 106 into the cavity 130 also provides sealing of the housing 102 at cavity 130.

In accordance with a further embodiment, housing 102 may further comprise a third antenna section 134 permanently located therein, wherein each of the plurality of replaceable cards with secondary antenna section disposed thereon 106, are configured to electronically couple between the first antenna section 104 and the third antenna section 134. Each replaceable card with secondary antenna section disposed thereon 106 can interchangeably couple to the first and third antenna sections 104, 134 upon insertion of the card into the cavity 130. Insertion of the card 106 into the cavity 130 also provides sealing of the housing 102 at cavity 130. Again, the electrical coupling may be inductive, capacitive, contact, or any suitable conductive interface for mating different sections of planar antennas.

Figure 2:
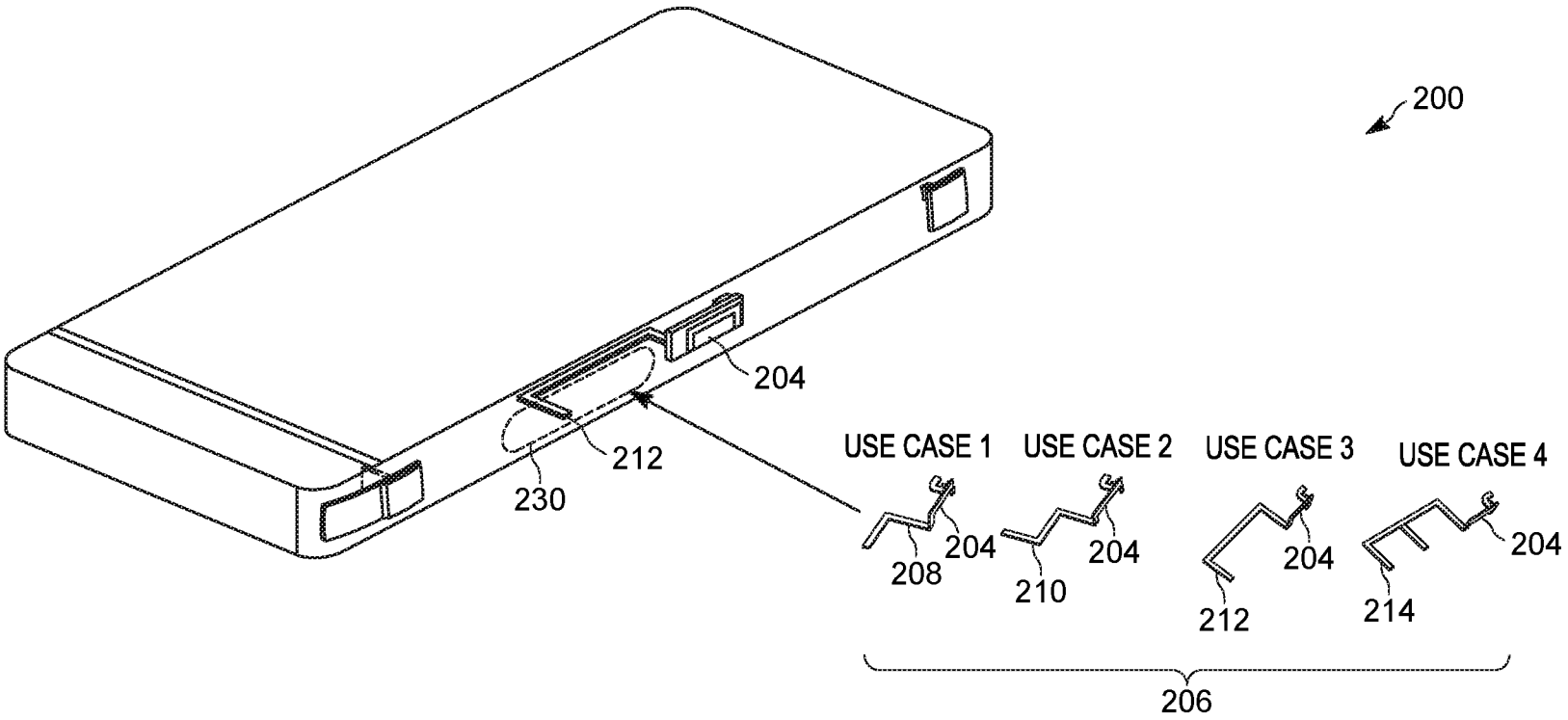
FIG. 2 is perspective view of a portable communication device and examples of a plurality of different secondary antenna configurations in accordance with some embodiments.

FIG. 2 is cut-away perspective view of a communication device 200 with housing 202 permanent antenna 204 located therein, and a cavity 230 for interchangeably accepting a plurality of plug-in secondary antenna sections 208, 210, 212, 214 in accordance with some embodiments. Each of the secondary antenna sections 208, 210, 212, 214 is disposed on its own replaceable card (not shown). Each of the overall antenna configurations provides operation for a different use case such as different geographic regions and/or service carriers.

Use case 1 shows a completed antenna formed of permanent primary antenna section antenna 204 and secondary antenna section 208. Use case 2 shows another completed antenna formed of permanent primary antenna 202 and secondary antenna section 210. Use case 3 shows another completed antenna formed of permanent primary antenna 202 and secondary antenna section 212. Use case 4 shows another completed antenna formed of permanent primary antenna 202 and secondary antenna section 214. The different use case configurations allow for a user to select a configuration best suited for predetermined geographic region and/or service carrier associated with each use case.

Hence, the communication device can be accommodated with a plurality of antenna configurations formed of the permanent primary section 204 and a plurality of interchangeable secondary sections 208, 210, 212, 214. Each of the antenna configurations 206 may be optimized for efficiency at a different frequency range and/or in some embodiments some of the antenna configurations may be optimized for efficiency at more than one frequency range.

The ability to plug in one card to operate over a frequency range for a use case of carrier 1, for example, and then remove and replace the card for a use case of carrier 2, for example, is highly advantageous to a user that utilizes their communication device for multiple use cases. The ability to configure the complete antenna into one of several antenna configurations enables improved selectivity performance thereby addressing the coexistence challenge. The configurability also advantageously provides for future bands which have not yet been standardized which is very useful for portable public safety communication devices.

Figure 3:
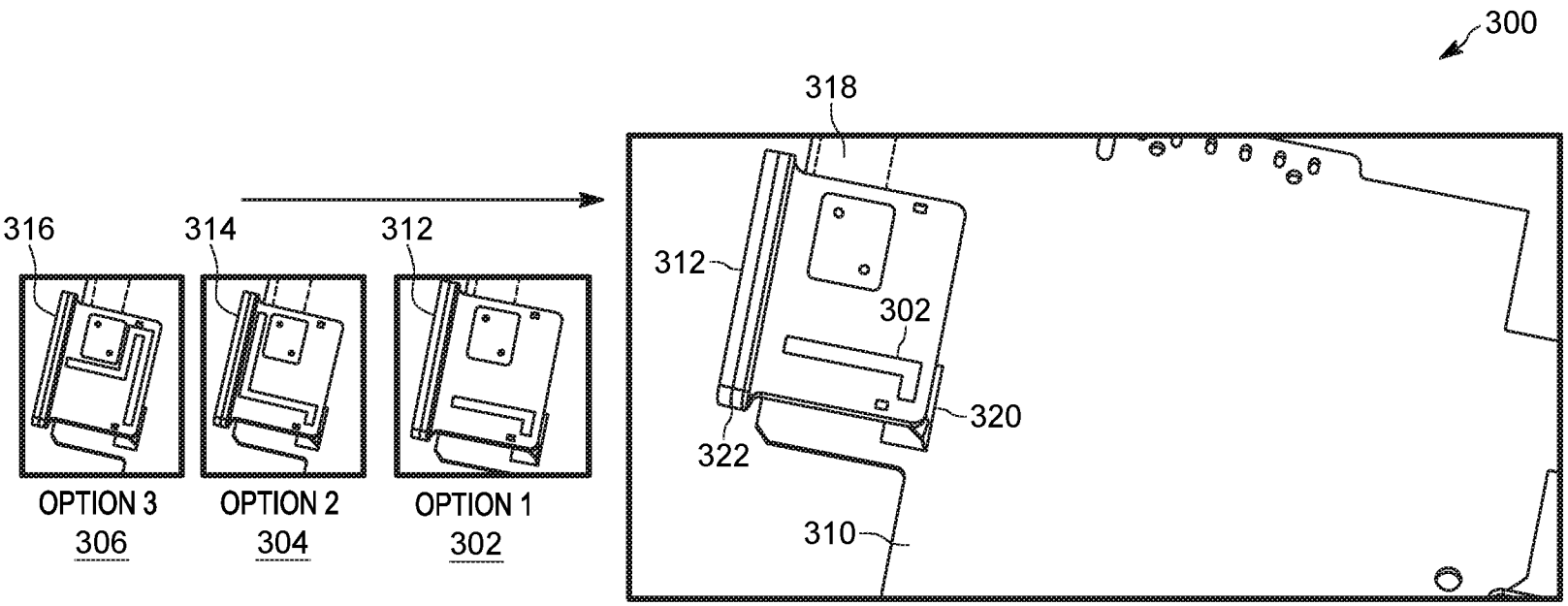
FIG. 3 shows examples of a plurality of different antenna configurations formed on an insertable and removable tray in accordance with some embodiments.

FIG. 3 shows examples different secondary antenna sections formed on insertable and removable card trays in accordance with some embodiments. View 300 shows a printed circuit board 310 of a communication device, such as communication device 100 of FIG. 1. Three different secondary antenna options are provided and shown as Option 1, Option 2, and Option 3, each providing a different secondary antenna section 302, 304, 306 respectively. In accordance with an embodiment, each secondary antenna section 302, 304, 306 is printed on its own replaceable card tray 312, 314, 316. A primary antenna section 318 is disposed on the PCB 310 which electrically couples to the currently inserted card tray antenna, shown here as card tray 312 with secondary antenna section 302 disposed thereon. A suitable interface is used to electrically couple the two antenna sections, for example a contact interface shown here as spring 320 located on PCB 310. It is appreciated that other electronic coupling configurations such as inductive coupling, capacitive coupling, and/or other contact interface may also be used. The plurality of replaceable card trays 312, 314, 316 may comprise, for example a plurality of memory card trays, such as subscriber identification module (SIM) card trays or a plurality of secure digital (SD) card trays. Each of plurality of replaceable card trays 312, 314, 316 with respective secondary antenna section 302, 204, 306 disposed thereon may further comprise matching circuitry for tuning the primary antenna section to a different frequency band.

Alternatively, in another embodiment that can also be described using FIG. 3, each of the replaceable card trays 312, 314, 316 with respective antenna 302, 304, 306 disposed thereon may operate as a primary antenna (without interface to another antenna section 318). In this alternative embodiment, each antenna 302, 304, 306 electrically couples to the main PCB 310, via a suitable coupling interface, such as spring 320 or other suitable coupling interface. An example of simulated antenna operation results for high band operation of the antenna options shown in FIG. 3 disposed on a plastic SD/SIM tray (each operating as a primary antenna without interface to another antenna section) generated the following simulated peak efficiency efficiencies:

| | Frequency Range | Peak Efficiency (%) |
|---|---|---|
| Option 1 | 5.5 GHz-6.5 GHz | 70 |
| Option 2 | 3.3-3.8 GHz and 6-7 GHz | 84 |
| Option 3 | 5.15 GHz-5.85. GHz | 76 |

The antenna simulations represented in the Table were performed using software CST (Computer Simulation Technology) wherein different traces were printed on a SIM tray associated with a radio and each trace represented a different passive antenna. The traces were electronically coupled to a spring 320 located on the radio PCB and an AC signal port was attached to the spring.

Hence, the embodiments of FIG. 3 provide for an antenna assembly comprising a data card tray and an antenna disposed on the data card tray. The data card tray embodiment is suitable as a stand-alone antenna approach or as a sectional antenna approach. The assembly may further comprise antenna tuning and matching elements disposed on the data card tray. Each replaceable card tray provides one or more frequency ranges operating with optimized efficiency. The ability to swap out and replace the card tray enables for extended, wider multiband operation.

Additionally, insertion of the card tray also provides sealing to the communication device housing via a compressible seal 322. The compressible seal 322 may be formed as an over-molded rubber seal along the perimeter of the tray handle or may be a separate gasket piece part. The seal 322 compresses between the inside and the outside of the communication device housing upon insertion of the card tray into the housing, thereby providing protection from water, dust, and debris from entering the housing. The replaceable card tray with antenna disposed thereon is advantageously user-replaceable, factory replaceable, and service shop replaceable.

Figure 4A:
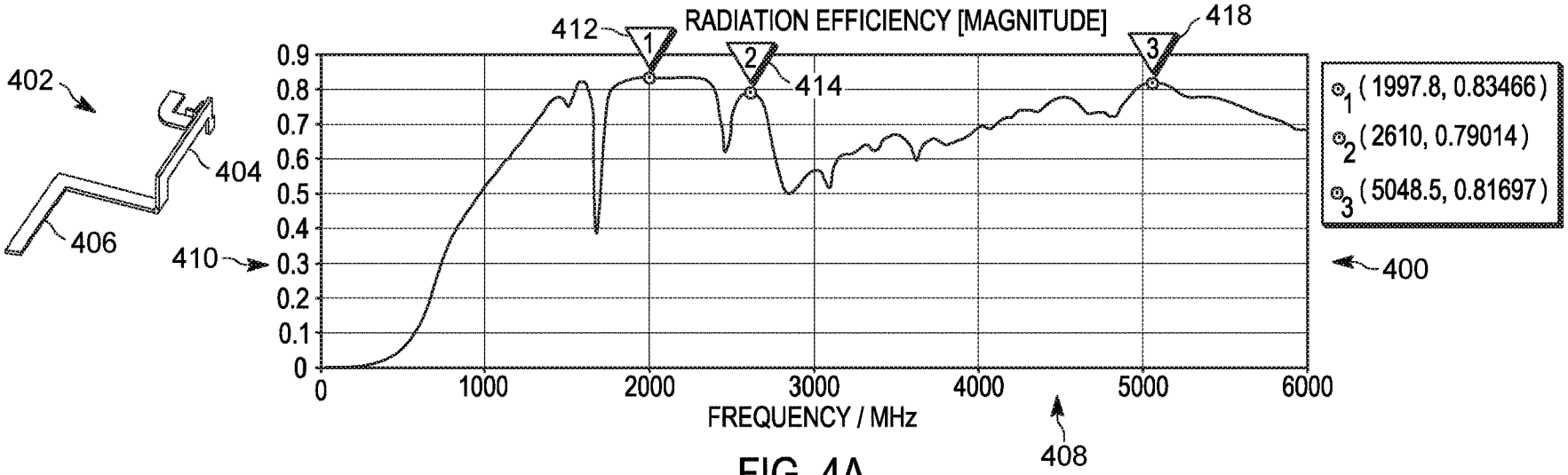
FIGS. 4A and 4B show examples of simulated radiation efficiency graphs for a first antenna section and two different secondary antenna sections formed in accordance with some embodiments.
Figure 4B:
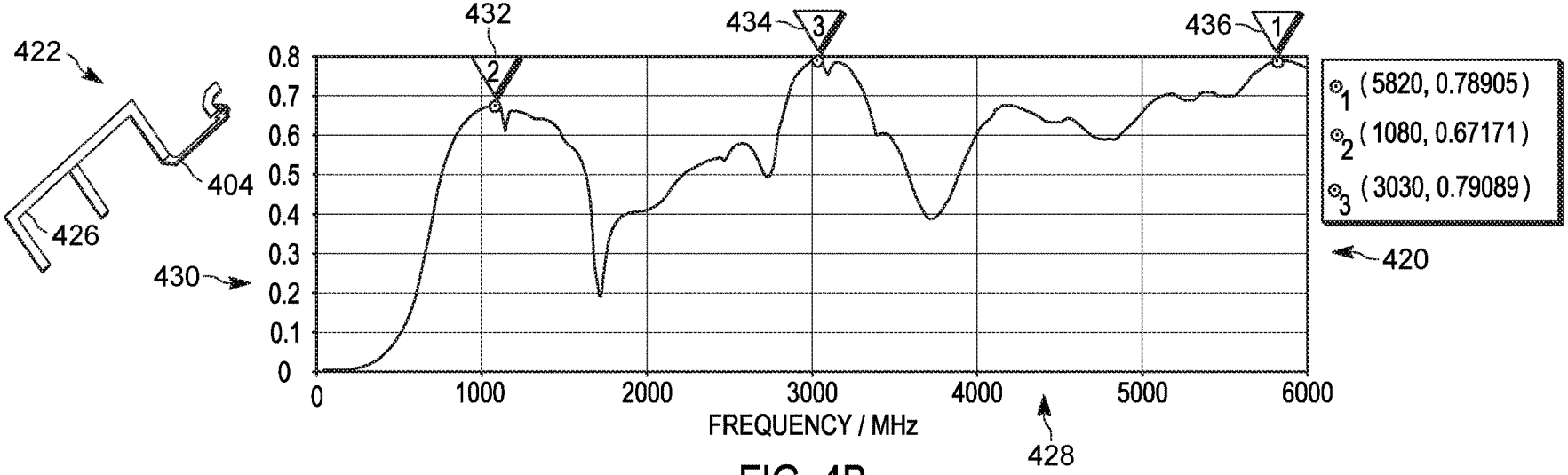

FIGS. 4A and 4B show examples of simulated radiation efficiency graphs for a first antenna section and two different secondary antenna sections formed in accordance with some embodiments. The simulation graph 400 of FIG. 4A was performed on a simulated antenna formation 402 using a primary section 404 formed as a first planar antenna (disposed in a radio—as previously described) electronically coupled with a secondary antenna section 406 formed as a planar L-shaped antenna (disposed on a plug-in tray—not shown) forming the complete antenna 402. The graph 400 provides a magnitude representation of radiated efficiency. Graph 400 shows frequency (MHz) along horizontal axis 408 over multiple bands, and shows a ratio of radiated antenna output power over input power along vertical axis 410. Designators 412, 414, and 416 of graph 400 indicate frequency ranges over which the antenna is performing with high efficiency.

The simulation graph 420 of FIG. 4B was performed on a simulated antenna formation 422 using the same primary section 404 for the first planar antenna (disposed in a radio—not shown) electronically coupled with a different secondary antenna section 426 formed as a planar E-shaped antenna (disposed on a plug-in tray—not shown) forming the complete antenna 422. The graph 420 provides a magnitude representation of radiated efficiency. Graph 420 shows frequency (MHz) along horizontal axis 428 (over the multiple bands as graph 400), and shows a ratio of radiated antenna output power over input power along vertical axis 430. Designators 432, 434, and 436 of graph 420 indicate frequency ranges over which the antenna 422 is performing with high efficiency.

As can be seen by comparing the two graphs 400, 420, the frequency ranges 412 over which each antenna configuration is operating with high efficiency are different. That is, the first antenna 402 is optimized for certain frequency ranges over multiple bands, while the second antenna 424 is optimized for different frequency ranges over the same multiple bands.

Thus, graphs 400, 420 provide a visual example of how two different secondary antenna cards can be interchangeable plugged in to a communication device to advantageously accommodate different frequency ranges associated with a user's current geographical location or current user assignment.

While graphs 400 and 420 have been provided as example, it is to be appreciated that the plug-in secondary antenna cards of the various embodiments can be formed to support multiple wireless technology protocols and frequency ranges, such as 5G/4G/3G/2G/WiFi, to name a few. The provision of a plurality of secondary plug-in antennas that interchangeably couple to a common primary antenna within the communication beneficially allows for the communication device to operate with improved efficiency over a plurality of frequency ranges over multiple bands.

The antenna configuration is able to support LTE Direct which is an autonomous long distance device-to-device (D2D) protocol introduced in 3GPP Release 12 specification. Since this LTE protocol is limited to 24 dBm transmit power, the coverage in this mode is limited to approximately 500 meters with current antenna approaches. The improved antenna configuration provided by the embodiments will allow for better coverage as the antenna card can be tuned for a dedicated LTE direct frequency range.

The antenna configuration provides improved selectivity performance thereby addressing the coexistence challenge. The configurability advantageously provides for future bands which have not yet been standardized, which is very beneficial for public safety communication devices in that the purchase of an entirely new communication device can be avoided.

In past antenna approaches, performance efficiency needed to be compromised in order to combine several frequency ranges on a single antenna in an attempt to cover all bands. By recognizing that particular sales regions only need particular bands (i.e. not all bands are required), the interchangeable antenna cards of the embodiments has been provided the advantageous ability to use a dedicated antenna card for a predetermined frequency range and swap that card out for another antenna card to cover another frequency range. The plug-in secondary antenna approach of the embodiments provides improved performance by reducing the complexity of the matching circuitry and simplifying the antenna tuner topology design—as each card can have its own optimized matching and tuning circuitry. The embodiments have provided for an antenna replacement card (e.g. SIM or SD card tray) that plugs into the radio antenna section and provides specific optimized antenna for the required group of frequencies for a desired sales region. The primary section in the device is common for all frequency bands that the antenna should cover and the secondary (complementary) plug-in card is unique for certain frequency bands. The antenna configuration provided by the embodiments beneficially accommodates modern portable communication devices which need to support multiple wireless technology protocols and frequencies such as 5G/4G/3G/2G/WiFi, to name a few. The antenna configuration of the embodiments allows for high performance over an ultra wide frequency range.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

We claim:

1. A portable communication device, comprising:

a housing; and a primary antenna section permanently located in the housing, the housing and primary antenna section being configured to interchangeably accept a plurality of replaceable cards, each replaceable card having a secondary antenna section disposed thereon for electronically coupling to the primary antenna section thereby forming a complete antenna entirely within the housing, and each completed antenna configuration being operable at one or more predetermined frequency ranges for multiband frequency operation of the portable communication device.

2. The portable communication device of claim 1, wherein the replaceable card with secondary antenna section disposed thereon is user-replaceable, factory replaceable, and service shop replaceable.

3. The portable communication device of claim 1, wherein the primary antenna section is a passive radiator and each replaceable card having secondary antenna section disposed thereon comprises tuning elements for different sub-bands.

4. The portable communication device of claim 3, further comprising:

a passive radiator disposed on at least one of the plurality of replaceable cards.

5. The portable communication device of claim 1, wherein the plurality of replaceable cards are formed as part of a plurality of card trays, the plurality of card trays being insertable to and removable from a slot of the housing.

6. The portable communication device of claim 5, wherein the plurality of card trays comprise one of:

a plurality of subscriber identification module (SIM) card trays; and a plurality of secure digital (SD) card trays.

7. The portable communication device of claim 5, wherein each secondary antenna section is printed on a SIM card tray.

8. The portable communication device of claim 5, wherein each secondary antenna section is printed on a SD card tray.

9. The portable communication device of claim 1, wherein each of the plurality of replaceable cards with secondary antenna section disposed thereon comprises matching circuitry.

10. The portable communication device of claim 1, wherein each of plurality of replaceable cards with secondary antenna section disposed thereon comprises matching circuitry for tuning the primary antenna section to a different frequency band.

11. The portable communication device of claim 1, further comprising:

a third antenna section permanently located in the housing, each of the plurality of replaceable cards with secondary antenna section disposed thereon being configured to electronically couple between the primary antenna section and the third antenna section.

12. The portable communication device of claim 1, wherein the portable communication device comprises a portable public safety communication device.

13. The portable communication device of claim 12, wherein the portable public safety communication device comprises a wearable portable public safety communication device.

14. The portable communication device of claim 13, wherein the wearable portable public safety communication device comprises at least one of:

a portable radio; and a remote speaker microphone.

15. The portable communication device of claim 1, wherein the plurality of replaceable cards with secondary antenna section disposed thereon provide multiband coverage for at least one of: 5G, 4G, 3G, 2G, WiFi, BLUETOOTH, Global Navigation Satellite System (GNSS), ZigBee, Terrestrial Trunked Radio (TETRA), Land Mobile Radio (LMR), and Long Term Evolution (LTE) direct protocols.

16. The portable communication device of claim 1, wherein the replaceable cards provide coverage over different geographic regions and different use cases.

17. The portable communication device of claim 1, wherein the replaceable cards retains sealing of the communication devices.

18. An antenna, comprising:

a data card tray; and an antenna disposed on the data card tray.

19. The antenna of claim 18, further comprising:

antenna tuning elements disposed on the data card tray.

20. The antenna of claim 18, wherein the antenna is printed on the data card tray.

21. A method of providing multiband operation to a portable communication device, comprising:

providing a first antenna section within a housing of the portable communication device;

inserting a replaceable card having a secondary antenna section disposed thereon into the housing, thereby electrically coupling the second antenna section to the first antenna section to form a complete antenna;

operating the portable communication device over a first frequency range of operation;

removing the replaceable card;

inserting another replaceable card having a different secondary antenna section disposed thereon into the housing, thereby electrically coupling the second antenna section to the first antenna section to form a different complete antenna; and operating the portable communication device over a second frequency range of operation.

22. The method of claim 21, wherein inserting the replaceable card further retains sealing of the portable communication device.

23. The antenna of claim 18, wherein the data card tray comprises a memory card tray.

24. The antenna of claim 18, wherein the memory card tray comprises one of:

a subscriber identification module (SIM) card tray; and a secure digital (SD) card tray.

* * * * *